US005285904A

United States Patent [19]

Haase

[11] Patent Number: 5,285,904

[45] Date of Patent: Feb. 15, 1994

[54] MAGNETIC SWEEPER CONSTRUCTION

[76] Inventor: Gerald A. Haase, 1005 Country Club Rd., Lake Oswego, Oreg. 97034

[21] Appl. No.: 992,284

[22] Filed: Dec. 16, 1992

[51] Int. Cl.[5] ..... B03C 1/00

[52] U.S. Cl. ..... 209/215; 209/228; 15/339

[58] Field of Search ..... 209/215, 228, 229; 294/65.5; 15/105, 339

[56] References Cited

U.S. PATENT DOCUMENTS

| | | | |
|---|---|---|---|
| 1,745,970 | 2/1930 | Andrew | 209/215 |
| 3,646,492 | 2/1972 | Westermann | 209/215 |
| 4,407,038 | 10/1983 | Haase | 15/105 |
| 4,554,703 | 11/1985 | Matuki | 209/215 |
| 4,904,376 | 2/1990 | Haase | 209/215 |
| 4,929,345 | 5/1990 | Meador | 209/215 |

FOREIGN PATENT DOCUMENTS

| | | | |
|---|---|---|---|
| 499121 | 1/1954 | Canada | 209/215 |
| 2367474 | 6/1978 | France | 209/215 |

*Primary Examiner*—D. Glenn Dayoan

*Attorney, Agent, or Firm*—Olson & Olson

[57] ABSTRACT

A hand-operated or vehicle-supported magnetic sweeper has a longitudinally elongated, hollow magnet-containing body member preferably formed in one piece of non-magnetic material which may include wheels mounted on its ends and a handle socket disposed centrally between the ends of the body member for reception of a handle member for hand operation of the sweeper over a floor surface. A rigid top cover plate is secured to the body member to cover and enclose the magnets contained in the hollow body and to provide rigidity to the sweeper construction. A catcher member formed of non-magnetic material is removably mounted on the body member so that metallic objects attracted to the magnet-containing body member are captured against the surface of the overlying catcher member and retained thereagainst until the catcher member is manually removed, whereupon the metal objects will simply fall away for discard. Wider magnetic sweeper units may be formed simply by securing individual body members together in end-to-end relationship by using longer, interconnecting top cover plates.

4 Claims, 3 Drawing Sheets

MAGNETIC SWEEPER CONSTRUCTION

BACKGROUND OF THE INVENTION

This invention relates to sweepers, and more particularly to a self-contained magnetic sweeper arranged to capture loose magnetic objects from floors, yards and construction sites as the sweeper is moved over the surface. Specifically, this invention relates to my earlier magnetic sweeper disclosed in U.S. Pat. No. 4,407,038, issued 4 October 1983, and provides an improved but simplified sweeper construction that is significantly more versatile in its range of uses.

The above identified patent is considered to be the most pertinent prior art in connection with the present invention. However, the patented device involves a complicated and rather expensive construction requiring inner and outer longitudinal reinforcing ribs and cross ribs, a plurality of individual, magnet-containing pockets each having its own front, rear, bottom and separate, spaced apart side walls, and a sweeper body/-wheel-axle configuration that is arranged specifically to present the magnet pockets at various heights above a floor surface depending on rotational orientation of the sweeper body about the axis of the axles. Although operation of the magnet sweeper in collecting metallic material from a floor is satisfactory, it's complex, multi-surface construction renders the device difficult to be cleaned of metallic material that has been captured by the sweeper, and removing this material from the sweeper involves a time consuming and inconvenient operation. Moreover, the earlier construction is not convertible to form functional, wider units and therefore requires a plurality of molds in order to provide sweeper units of different widths.

Also of general relevance to the present invention is my U.S. Pat. No. 4,904,376, issued 27 February 1990 entitled Metal Catching Cover, in which is disclosed a multi-pocketed cover member configured to removably cover the outer surface areas of the plurality of individual magnet pockets of magnetic cleaning devices of my earlier invention. This cover construction is very strictly limited to the particular configuration of the particular cleaning device that it is to be used with, e.g. different sizes and types of magnetic cleaning devices require specific, correspondingly different cover member.

SUMMARY OF THE INVENTION

In its basic concept, this invention provides a greatly simplified and more economical magnetic sweeper construction arranged to present a permanent magnet above a floor surface for movement thereof over the surface to pick up and collect metallic material from the floor surface, the sweeper body being provided as a modular configuration which can be easily assembled in various configurations to provide sweeper units of selected widths by connecting basic sweeper moduls together with common cover plates, the sweeper also including a removable catcher overlying the surface of the sweeper body, whereby metallic material will be collected on the surface of the catcher during operation of the sweeper and will simply fall away when the catcher is manually removed from the body of the sweeper.

It is by virtue of the foregoing basic concept that the principle objective of this invention is achieved; namely, the provision of a simplified sweeper construction by which the simple and efficient removal of metallic objects from the surface is obtained, and their quick and convenient disposal may be achieved.

A further object of this invention is the provision of a magnetic sweeper of the class described which may mount wheels and a handle member for hand propelling across a surface or alternatively may be configured to be carried by a vehicle in industrial, commercial and construction environments where large surface areas are involved.

A still further object of this invention is the provision of an improved magnetic sweeper device of the class described which is of simplified construction for economical manufacture and assembly, and ease of use.

The foregoing and other objects and advantages of this invention will appear from the following detailed description, taken in connection with the accompanying drawings of preferred embodiments.

DESCRIPTION OF THE PREFERRED EMBODIMENTS

Figures 1, 4:
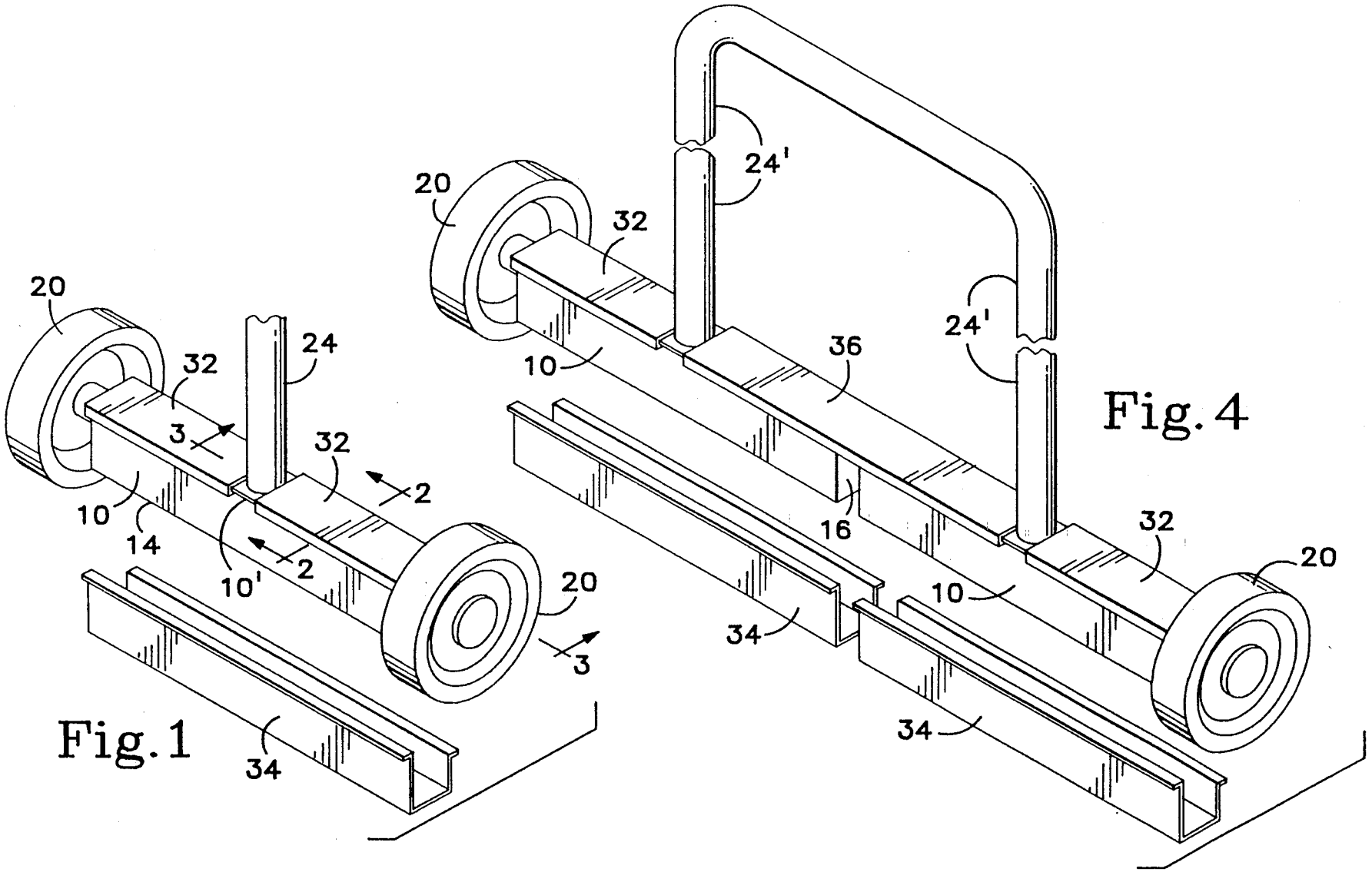
FIG. 1 is a fragmentary perspective view of a basic sweeper construction embodying the features of this invention, the removable cleaning catcher being separated from the sweeper body to clearly illustrate its removability.
FIG. 4 is a foreshortened perspective view of another embodiment of the magnetic sweeper construction of this invention illustrating a wider version of the magnetic sweeper of FIG. 1 achieved by the simple securing of two sweeper bodies of FIG. 1 together with an interconnecting top cover plate.
Figure 2:
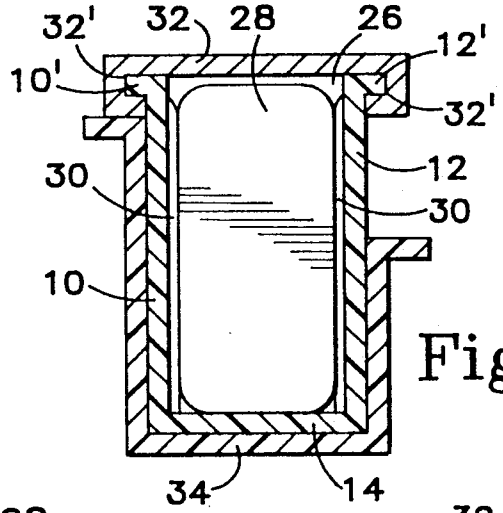
FIG. 2 is an enlarged cross sectional view of the magnetic sweeper of FIG. 1, taken along the line 2—2 in FIG. 1 but showing the removable catcher in installed condition on the sweeper body.
Figure 3:
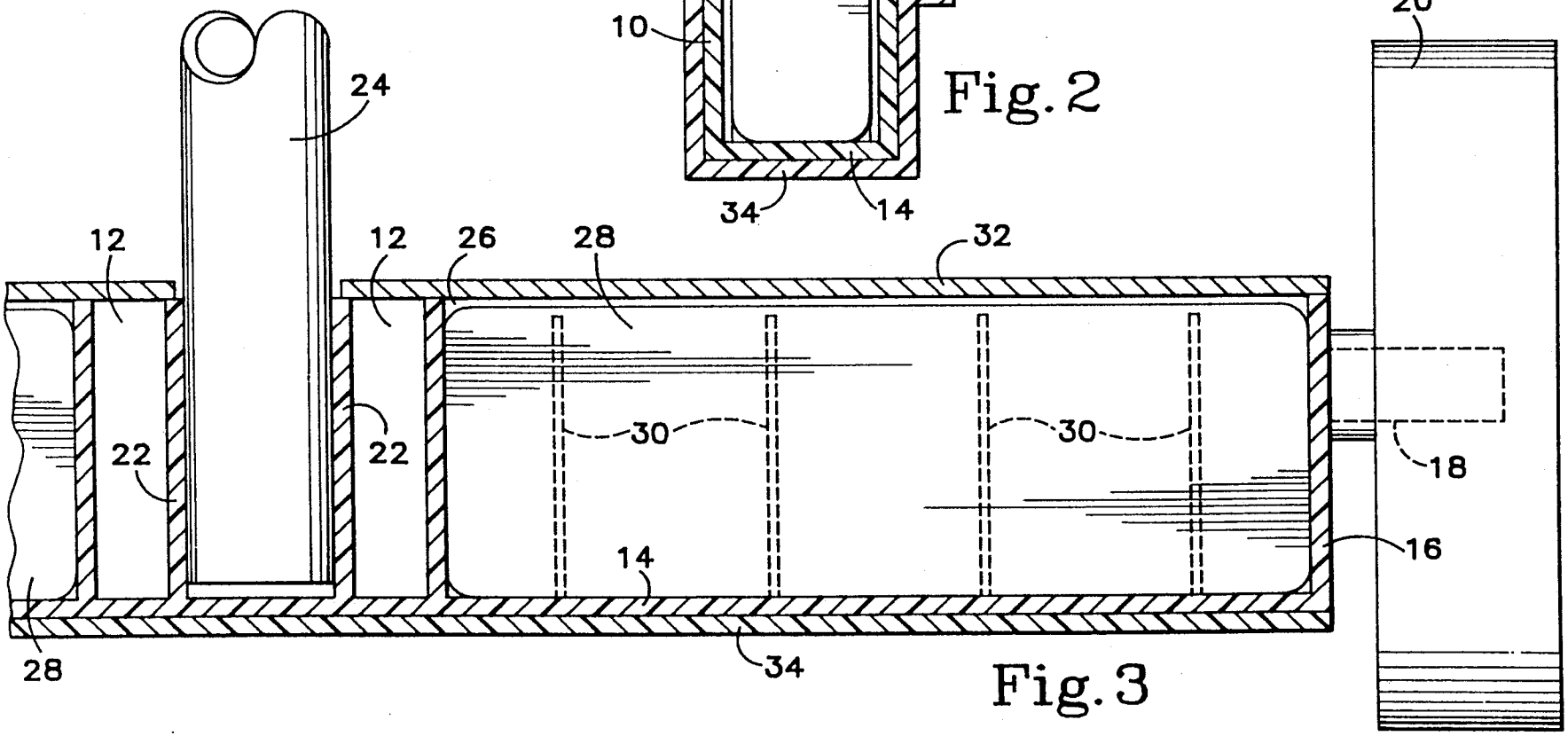
FIG. 3 is an enlarged longitudinal fragmentary sectional view taken along the line 3—3 in FIG. 1, the removable cover member being shown in installed condition.

FIGS. 1, 2 and 3 illustrate the improved and simplified construction of the magnetic sweeper of this invention. As illustrated, the sweeper comprises an elongated, substantially hollow main body member having a front wall 10, a rear wall 12, a bottom wall 14 and opposite, end walls 16. The body member is formed of non-magnetic material and preferably is molded of plastic in a one-piece construction to minimize manufacturing costs.

The sweeper is illustrated as including axles 18 mounted to and extending outwardly from the end walls 16 of the body member. Each axle is configured to receive for rotation a wheel 20 which is configured to support the sweeper body a desired distance spaced above an underlying floor or other surface.

As illustrated in FIGS. 1 and 3, the body member is configured with a handle socket member 22 disposed preferably centrally between the ends of the body member. The socket member is configured to receive a handle member 24, as by press fit, for extension therefrom a sufficient length to be comfortably held by hand while the wheels supporting the base member are disposed in rolling contact with an underlying floor or other surface.

Referring now primarily to FIGS. 2 and 3 of the drawings, the body member includes a pair of hollow compartments 26 extending laterally outward from each side of the handle socket member 22 to the end walls 16. These compartments 26 are each configured to receive a preferably single, elongated permanent magnet 28. These magnets may be retained in their respective compartments against rattling movement, etc. by any suitable, conventional means such as by configuring the compartments of dimensions that frictionally secure the magnets in place, or by adhering the magnets in their respective compartments with adhesive or the like, or, as illustrated, by the provision of inwardly projecting tabs 30 molded into the front and rear side walls 10, 12 to frictionally grasp the magnets and secure them immovably in place within the compartment and prevent any undesirable noise-making movement of the magnets therein.

Top cover plate means is provided to be secured to and overlie the top of the body member so as to enclose the magnet containing compartments. In the embodiments illustrated, the upper edges of the front wall 10 and the back wall 12 include outwardly projecting flange members 10', 12' that are configured to be received within the corresponding guide slots 32' of a cover plate 32 which is preferably extruded of non-magnetic material such as synthetic thermoplastic resin or rigid, non-magnetic metal such as aluminum, as is illustrated.

The top guide cover 32 are installed by engaging the projecting flanges 10', 12' in the corresponding guide slots 32' and sliding the cover plates inwardly from the outside edges of the body toward the handle socket member 22. Once installed, the top cover plates help to rigidify the body member while also serving to enclose the magnet-containing compartments 26. The cover plates may be secured in their final condition by any conventional means such as by bonding or crimping in order to ensure against any further sliding movement. Once the cover plates are installed, the wheels 20 may be fitted onto their respective axle members 18.

The magnetic sweeper embodied in FIG. 1 of the drawings also includes removable metallic debris catcher means configured for quick and easy installation and removal from the body member overlying the front, rear and bottom walls of the body member. In the embodiments illustrated, this removable catcher means comprises a substantially U-shaped member 34 preferably formed by extruding a non-magnetic material such as synthetic thermoplastic resin and then cut to lengths sufficient to cover the front, rear and bottom walls of the body member between the ends walls 16. The catcher member 34 is further configured so as to fit snugly onto the body member for a tight but removable frictional fit to prevent inadvertent separation of the catcher member except when it is intentionally pulled off by an operator of the sweeper. FIG. 1 shows the magnetic sweeper construction of this invention with the removable catcher member separated therefrom and in condition for installation onto the body member, while the sectional views of FIGS. 2 and 3 illustrate the magnetic sweeper of this invention with the removable catcher member 34 installed on the body member.

In operation, the magnetic sweeper, with the removable catcher member 34 installed thereon, is rolled across a floor surface whereby the magnetic attraction of the magnets contained within the body member causes loose metallic objects and debris on the floor surface to be picked up and held against the surface area of the catcher member 34. When the floor sweeping operation is done, the sweeper may be held over a garbage receptacle or the like and the catcher member grasped at one of its ends and pulled downwardly to separate it from the body member and the maqnetic attraction provided thereby, whereupon the metallic objects held against the catcher member will simply fall away and into the receptacle for discard. The catcher sleeve member 34 is then reinstalled on the body member, and the magnetic sweeper is again ready for another use.

Figure 5:
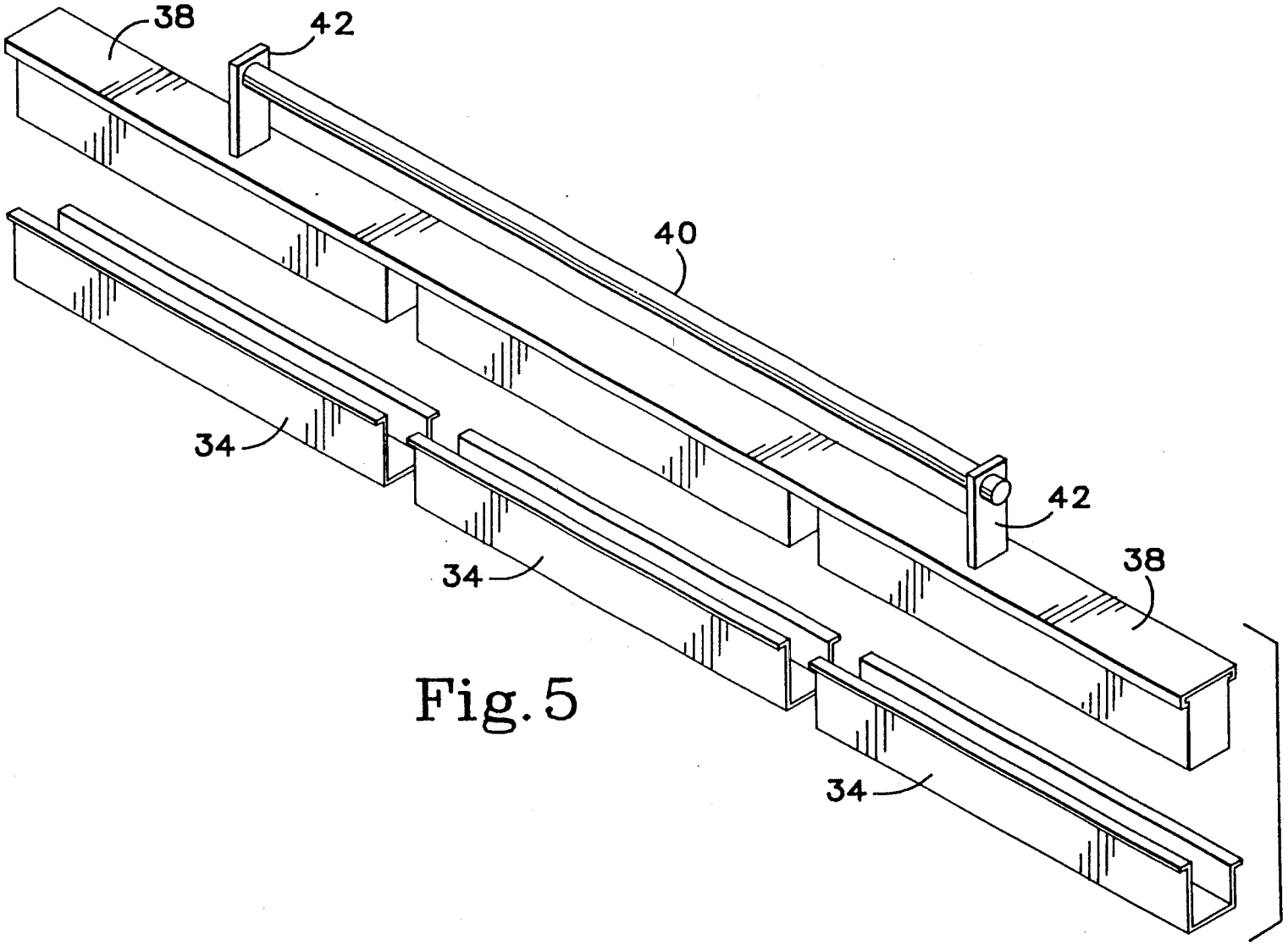
FIG. 5 is a perspective view of another embodiment of the magnetic sweeper construction of this invention utilizing a plurality of basic sweeper bodies illustrated in FIG. 1 of the drawings interconnected by a single, elongated top cover plate that mounts a carrying handle member configured to be engaged by the forks of a lift truck or other vehicle for operation of the vehicle about an expanded area in picking up metallic debris from a floor surface.

With the foregoing basic structure of the simplified magnetic sweeper construction of this invention thus understood, the versatility and adaptability of this construction is highlighted by examination of FIGS. 4 and 5 of the drawings wherein there is shown two modified versions of the magnetic sweeper of my invention formed substantially only by the connecting together of two or more of the sweeper bodies of FIG. 1 to form laterally elongated, wider magnetic sweepers that are particularly well suited for other purposes.

Referring first to the embodiment of FIG. 4, it is readily apparent that two sweeper units of FIG. 1 are secured together in end-to-end relationship to form a wider, single sweeper unit. In this regard, the confronting end walls 16 of each body member ma be configured without their respective axle members 18, or alternatively, the axle members may remain and be secured together with an interconnecting hollow sleeve member (not shown) receiving each axle in a tight, frictional fit. The only other modifications that are required to form the magnetic sweeper construction embodied in FIG. 4 of the drawings is the provision of an elongated, central cover plate 36, similar to cover plate 32 but cut longer from an extrusion of non-magnetic material such as aluminum, and the provision of a handle member 24' that is configured to accommodate the two handle socket members 22 that are formed by the linking of two single body members together. Although the drawing illustrates two individual removable catcher members 34, in order to clearly highlight the linking of multiple body members together to form a single unit, it may be preferable to form the catcher member of the sweeper of FIG. 4 in one continuous length, rather than the two lengths shown, both to assure against the capturing of metallic material by the body member itself between the catcher members, and to provide for increased rigidity of the elongated body member for use.

The embodiment illustrated in FIG. 5 of the drawings provides a yet longer magnetic sweeper construction that is provided without end axle members 18, and therefore illustrates an embodiment which is not intended as a hand propelled sweeper. In this regard, a plurality of individual body members are secured together in end-to-end relationship as has previously been described in connection with the embodiment of FIG. 4. In the embodiment illustrated, a single, rigid, non-magnetic top cover plate 38 is provided to secure the individual body members together into a rigid, laterally extending single unit. The top cover plate in this embodiment mounts sweeper carrying means which for simplicity of illustration herein is shown simply as a carrying handle member 40 mounted on the cover plate 38 by brackets 42, the carrying handle member in this case being configured to be supported by the forks of a conventional lift truck so that the magnetic sweeper assembly hangs freely downward therefrom. Operation of the lift truck about the floor area with the magnetic sweeper disposed above the floor surface provides the sweeper operation quickly over large floor surface areas.

It is to be understood that other mounting arrangements may be provided as needed in order to secure the magnetic sweeper to a vehicle or the like in a desired position above a ground surface. Also, as discussed in connection with FIG. 4 of the drawings, the removable catcher members 34 shown in FIG. 5 may alternatively be provided as a single-length extrusion, or individual multiple lengths as shown, as desired, depending on the actual length of the particular sweeper construction. Additionally, the single top cover plate 38 illustrated may alternatively be provided in multiple sections, such as seen in FIG. 4, if desired for more convenient packaging, etc.

From the foregoing it will be apparent to those skilled in the art that the present invention provides a greatly simplified construction over the complex, multipocketed version of my earlier invention, while also specifically addressing the important need of quickly and easily cleaning the sweeper of metals collected thereby, and even further by providing a sweeper construction that is uniquely versatile and adaptable in forming different versions that are suited to different needs in the most simplified and cost-effective manner, as has been described hereinbefore. It will also be apparent to those skilled in the art that various changes may be made in the size, shape, type, number and arrangement of parts described hereinbefore without departing from the spirit of this invention and the scope of the appended claims.

Having thus described my invention and the manner in which it may be used, I claim:

1. A magnetic sweeper comprising:

a) a laterally elongated body member of non-magnetic material having front, rear, bottom and end walls defining a compartment open at the top thereof, b) a permanent magnet in the compartment, c) forwardly and rearwardly extending flanges on the upper ends of the front and rear walls, d) at least one laterally elongated, rigid cover member configured to overlie the open top of the compartment, e) the forward and rearward sides of the cover member terminating in reverse bends configured to form laterally extending guide slots configured to receive therein said forwardly and rearwardly extending flanges, for retaining the cover member on the body member over the open top of the compartment, f) a catcher member of non-magnetic material having front, rear and bottom sides, the front and rear sides being configured for engaging the front and rear outer sides of the body member with the bottom side of the catcher member overlying the bottom side of the body member, and g) handle means operatively engaging the body member for manipulating the sweeper over a surface to be swept of magnetic materials.

2. The magnetic sweeper of claim 1 wherein rigid the cover member and the catcher member are extrusions of non-magnetic material.

3. The magnetic sweeper of claim 1 including a pair of said body members arranged end-to-end, and a rigid cover member spanning adjacent portions of said body members.

4. The magnetic sweeper of claim 1 including a plurality of said body members arranged end-to-end, and a rigid cover member spanning all of said body members and retaining them in said end-to-end relationship.

* * * * *